United States Patent [19]

Okigami et al.

[11] 4,065,247

[45] Dec. 27, 1977

[54] APPARATUS FOR INCINERATING WASTE GASES

[75] Inventors: Noboru Okigami; Yoshitoshi Sekiguchi; Takusen Ito; Kenji Onose, all of Osaka, Japan

[73] Assignee: Hitachi Shipbuilding and Engineering Co., Ltd., Osaka, Japan

[21] Appl. No.: 743,251

[22] Filed: Nov. 19, 1976

[30] Foreign Application Priority Data

Apr. 16, 1976 Japan ..... 51-48244[U]

[51] Int. Cl.[2] ..... F23D 13/20

[52] U.S. Cl. ..... 431/202; 431/5; 431/174; 431/285

[58] Field of Search ..... 431/202, 5, 174, 175, 431/179, 180, 284, 285; 23/277 C

[56] References Cited

U.S. PATENT DOCUMENTS

| | | | |
|---|---|---|---|
| 3,703,349 | 11/1972 | Straitz | 431/202 |
| 3,933,420 | 1/1976 | Zink et al. | 431/202 |
| 3,985,494 | 10/1976 | Childree | 431/175 |

*Primary Examiner*—Edward G. Favors

*Attorney, Agent, or Firm*—Allison C. Collard

[57] ABSTRACT

An apparatus for incinerating a waste gas comprises a combustion furnace main body having a peripheral wall and a hearth and a plurality of flare burners disposed on the hearth. Each of the flare burners including a burner main body having a peripheral wall and a bottom wall, at least one of the walls of the burner main body being formed with air intakes, an inwardly projecting flange provided on an upper portion of the peripheral wall of the burner main body, gas-air mixture tubes downwardly extending through the flange and arranged at a given spacing, a waste gas main pipe disposed under the burner main body, waste gas branch pipes extending upward from the waste gas main pipe, and gas nozzles mounted on the upper ends of the waste gas branch pipes respectively and positioned at the lower ends of the gas-air mixture tubes. The waste gas forced out from the nozzles ascends the interior of the mixture tubes along with the surrounding air and the gas-air mixture jets out from the tubes. When the mixture is ignited and burned, the swirling air currents produced above the flange support the combustion.

9 Claims, 3 Drawing Figures

APPARATUS FOR INCINERATING WASTE GASES

The present invention relates to an apparatus for incinerating waste gases, and more particularly to an apparatus for incinerating flammable waste gases discharged from refineries, petrochemical plants, etc.

Flare burners included in conventional waste gas incinerators are provided with steam nozzles for forcing water vapor against the flames jetting out from gas nozzles, because the waste gas can not be burned completely with use of the gas nozzles alone. Particularly, this tendency becomes pronounced when the waste gas is a hydrocarbon gas having a high molecular weight, entailing the production of black smoke. For this reason, steam is forced against the flames, causing water gas reaction between the free carbon and the steam to inhibit the black smoke. However, this necessitates large quantities of steam, rendering the equipment costly to maintain.

This invention provides an apparatus for incinerating waste gases which is free of the above problem. The apparatus comprises a combustion furnace main body having a peripheral wall and a hearth and a plurality of flare burners disposed on the hearth, each of the flare burners including a burner main body having a peripheral wall and a bottom wall, at least one of the walls of the burner main body being formed with air intakes, an inwardly projecting flange provided on an upper portion of the peripheral wall of the burner main body, gas-air mixture tubes downwardly extending through the flange and arranged at a given spacing, a waste gas main pipe disposed under the burner main body, waste gas branch pipes extending upward from the waste gas main pipe, and gas nozzles mounted on the upper ends of the waste gas branch pipes respectively and positioned at the lower ends of the gas-air mixture tubes.

By virtue of the arrangement in which the waste gas nozzles are positioned at the lower ends of the mixture tubes, a gas-air mixture suitable for combustion can be formed prior to the combustion of the gas. The inwardly projecting flange on an upper portion of the peripheral wall forms the air flowing upward along the peripheral wall into swirling currents above the flange, efficiently affording air to the mixture jetting out from the mixture tubes and thereby assuring complete combustion. The flange serves also as a baffle by which the air ascending the interior of the burner main body is prevented from coming into direct contact with the flames, while the upper portion of the peripheral wall of the burner main body protects the flames against the wind blowing laterally of the burner main body to thereby ensure stable combustion.

This invention will be described below in greater detail with reference to the accompanying drawings.

Figure 1:
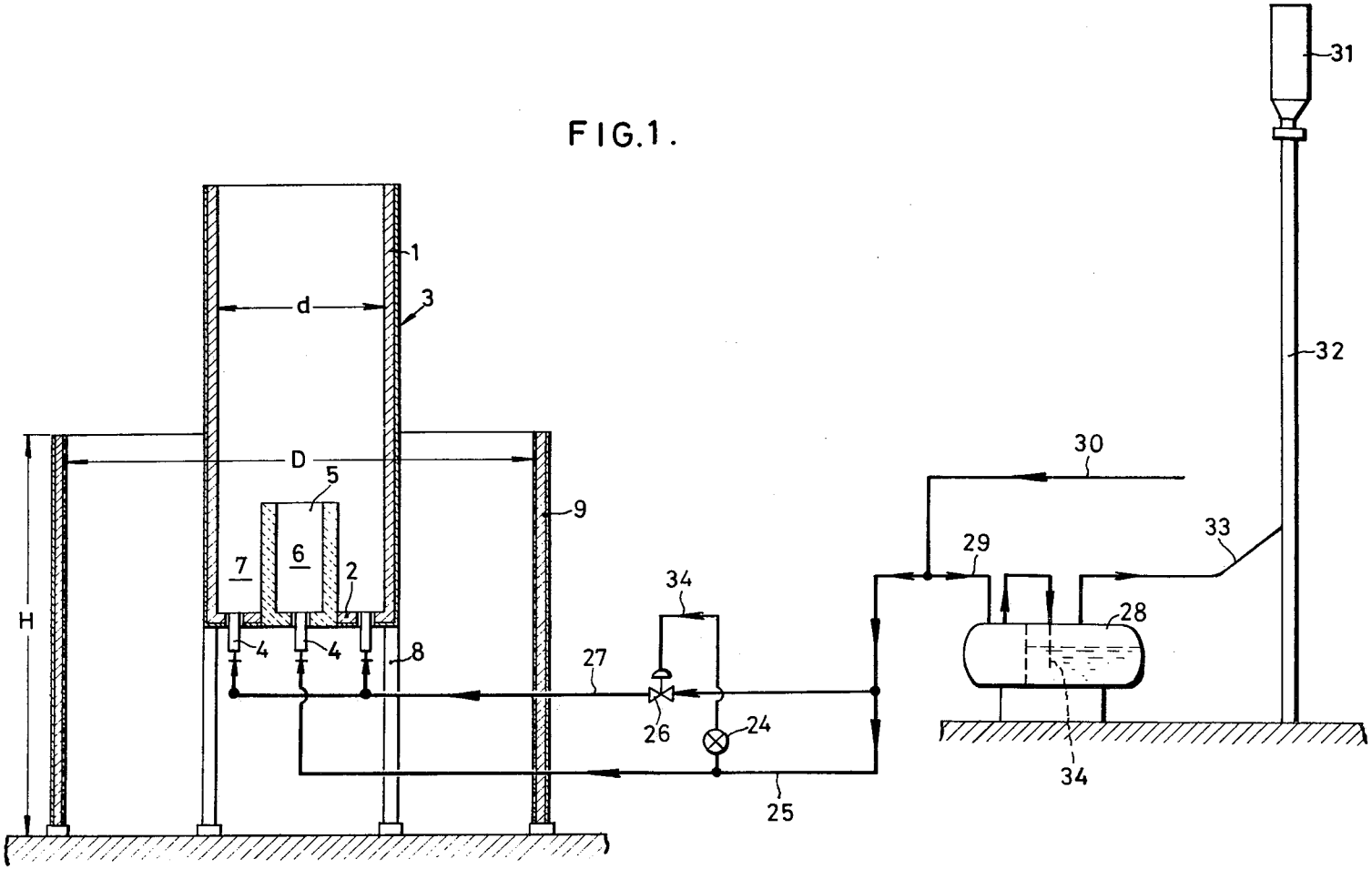
FIG. 1 is a diagram showing a waste gas incinerating apparatus of this invention in its entirety with its piping system schematically shown.

With reference to FIG. 1, a combustion furnace includes a main body 3 having a cylindrical peripheral wall 1 and a hearth 2, a plurality of flare burners 4 disposed on the hearth 2, and a combustion stabilizing tube 5 positioned upright on the hearth 2 at its center and surrounding a required number of the flare burners 4. The interior of the stabilizing tube 5 serves as an inner combustion chamber 6, while the space between the stabilizing tube 5 and the peripheral wall 1 of the combustion furnace main body 3 serves as an outer combustion chamber 7. The main body 3 is made of refractory bricks and covered with a steel sheet over the outer surface thereof. A refractory plastic material is usable in place of refractory bricks. The stabilizing tube 5 is also made of refractory bricks. Preferably, the stabilizing tube 5 has one-fourth to one-half the size of the main body 3. It is preferable to provide one to three flare burners 4 within the stabilizing tube 5. The main body 3 is supported by a plurality of posts 8. The lower portion of the main body 3 including the posts 8 is surrounded, at a specified spacing, by a cylindrical soundproof wall 9 made of a laminate of iron sheet, glass wool and porous board. Assuming that the inside diameter of the peripheral wall 1 is $d$, the inside diameter of the soundproof wall 9 is $D$ and the height of the same is $H$, it is preferable that $D = 1.5d$ to $2.0d$ and $H = 0.5d$ to $1.0d$. The soundproof wall 9 also provides protection against fire and wind. For soundproofing, it is preferable that the wall 9 have the greatest possible height and a small inside diameter so as to be positioned as close as possible to the main body 3. However, the reverse is preferable for the intake of combustion air. The above-mentioned ranges of the dimensions are determined as a compromise combining these contradictory relations together.

Figure 3:
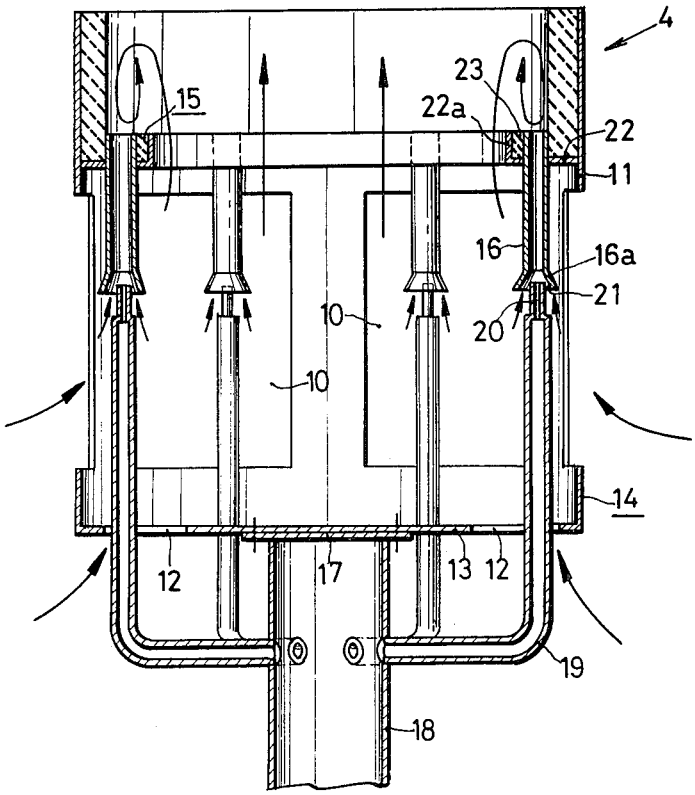
FIG. 3 is an enlarged view in section taken along the line III—III in FIG. 2.
Figure 2:
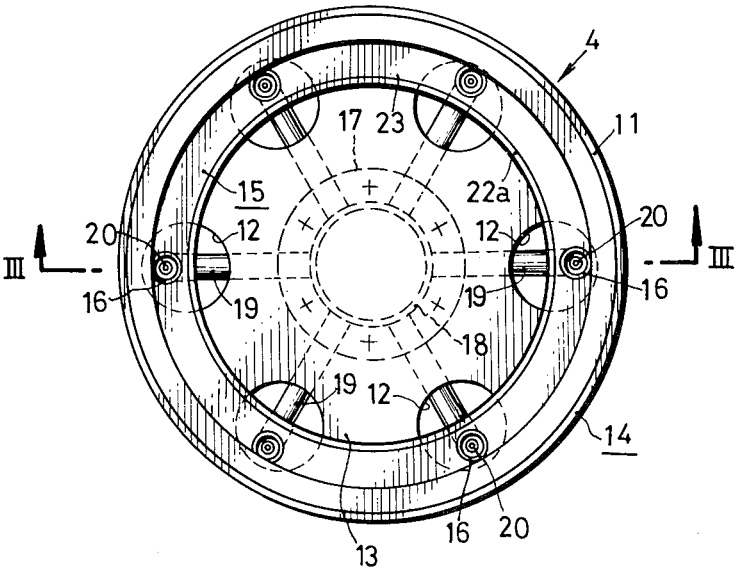
FIG. 2 is an enlarged view in vertical section showing a flare burner.

With reference to FIGS. 2 and 3, the flare burner 4 comprises a burner main body 14 having a peripheral wall 11 formed with a plurality of large quadrilateral air intakes 10 at a specified spacing and a bottom wall 13 formed with a plurality of circular air intakes 12 spaced apart from each other by a specified distance and positioned close to its periphery, an inwardly projecting flange 15 provided on an upper portion of the peripheral wall 11 and positioned slightly above the air intakes 10, gas-air mixture tubes 16 downwardly extending through the flange 15 and arranged at a given spacing, a waste gas main pipe 18 secured to the lower surface of the burner main body 14 with a disk 17 interposed therebetween, waste gas branch pipes 19 extending upward from the waste gas main pipe 18 through the air intakes 12 in the bottom wall 13, and gas nozzles 20 mounted on the upper ends of the waste gas branch pipes 19 respectively and positioned immediately below the lower ends of the gas-air mixture tubes 15 in opposed relation thereto.

Each of the gas-air mixture tube 16 is provided at its lower end with a flaring inlet port 16*a* into which the upper end of the nozzle 20 extends. The space between the outer peripheral surface of the nozzle 20 and the inner peripheral surface of the inlet port 16*a* serves as an air admitting space 21. The inwardly projecting flange 15 comprises an annular metal plate 22 having an L-shaped cross section and a refractory layer 23 having an upper surface flush with the top of the upstanding edge 22*a* of the plate 22. The refractory layer 23 is integral with a refractory layer provided on the inner surface of the peripheral wall 11 above the flange 15. Although not fully shown in FIG. 1, 48 flare burners 4 having the foregoing construction are provided on the hearth 2, three of which are positioned within the inner combustion chamber 6.

With reference to FIG. 1 again, the waste gas main pipes 18 for the inner combustion chamber 6 are connected to a first waste gas duct 25 having a pressure detector 24. The waste gas main pipes 18 for the outer combustion chamber 7 are connected to a second waste gas duct 27 having a valve 26 and branching off from the first waste gas duct 25. A main waste gas duct 30 from a waste gas supply branches into the first waste gas duct 25 and a waste gas duct 29 connected to a gas seal drum 28. A waste gas duct 33 extending from the gas seal drum 28 is connected to a flare stack 32 having a flare burner 31 at its upper end. The pressure detector 24 is electrically connected to the valve 26 so that when the waste gas has been introduced into the first waste gas duct 25 to specified pressure, the pressure detector 24 detects the pressure and emits a signal 34 which opens the valve 26 on the second waste gas duct 27. The pressure detector 24 is set for opening the valve 26 at a value corresponding to the upper limit of the waste gas supply to the inner combustion chamber 6. The pressure detector 24 is set for closing the valve 26 at a low value so that the value 26 will not be closed in the event the pressure within the waste gas duct 25 suddenly drops when the valve 26 is opened. The gas seal drum 28 includes a tube 34 extending into the water therein. The length of the tube 34 immersed in the water is so determined that when the waste gas is admitted to the main waste duct 30 at a rate in excess of the predetermined capacity of the combustion furnace, the water seal of the gas seal drum 28 will be broken.

With reference to FIGS. 1 to 3, the waste gas supplied from the main waste gas duct 30 to the first waste gas duct 25 flows into the waste gas main pipes 18 of the flare burners 4 for the inner combustion chamber 6, from which the gas dividedly flows into the waste gas branch pipes 19 and is injected into the mixture tubes 16 through the nozzles 20. The force of the gas flow draws air into the mixture tubes 16 through the air admitting spaces 21. While ascending the tubes 16, the air is mixed with the waste gas. The resulting gas-air mixture jets out from the upper ends of the tubes 16 and is burned upon being ignited by an unillustrated pilot burner which is lighted at all times. At this time, the air flowing upward along the peripheral wall of the burner main body 14 strikes the inwardly projecting flange 15 and is formed into swirling currents above the flange 15, thus efficiently supporting the combustion.

While the waste gas flows through the first waste gas duct 25 at an increasing rate, the pressure of the gas reaches the value at which the pressure detector 24 is set for opening the valve 26 on the second waste gas duct 27, whereupon the valve 26 is opened. As a result, the flare burners 4 within the outer combustion chamber 7 start to burn the gas in the same manner as above. In the event the waste gas supply through the first waste gas duct 25 reduces, entailing a pressure drop to a level not higher than the value at which the pressure detector 24 is set for closing the valve 26, the valve 26 is closed.

If the waste gas is introduced into the main waste gas duct 30 at a rate in excess of the predetermined capacity of the combustion furnace, the water seal of the gas seal drum 28 is broken, permitting the excess of the waste gas to flow into the flare stack 32 and to be burned by the flare burner 31.

Although the waste gases are discharged from chemical plants and the like at greatly varying rates, the gas can be burned appropriately in accordance with the rate of supply by the inner combustion chamber 6 alone, or both the inner and outer combustion chambers 6 and 7, or the combustion furnace including the chambers 6 and 7 and the flare stack.

This invention may be embodied differently without departing from the spirit and basic features of the invention. Accordingly the embodiment herein disclosed is given for illustrative purposes only and is not in any way limitative. It is to be understood that the scope of this invention is defined by the appended claims rather than by the specification and that various alterations and modifications within the definition and scope of the claims are included in the claims.

What is claimed is:

1. An apparatus for incinerating a waste gas comprising a combustion furnace main body having a peripheral wall and a hearth and a plurality of flare burners disposed on the hearth, each of the flare burners including a burner main body having a peripheral wall and a bottom wall, at least one of the walls of the burner main body being formed with air intakes, an inwardly projecting flange provided on an upper portion of the peripheral wall of the burner main body, gas-air mixture tubes downwardly extending through the flange and arranged at a given spacing, a waste gas main pipe disposed under the burner main body, waste gas branch pipes extending upward from the waste gas main pipe, and gas nozzles mounted on the upper ends of the waste gas branch pipes respectively and positioned at the lower ends of the gas-air mixture tubes.

2. An apparatus as defined in claim 1 wherein each of the gas-fuel mixture tubes is provided with a flaring inlet port at its lower end.

3. An apparatus as defined in claim 1 wherein the inner inwardly projecting flange comprises an annular metal plate having an L-shaped cross section and a refractory layer having an upper surface flush with the top of an upstanding edge of the annular metal plate, the refractory layer being integral with a refractory layer provided on the inner surface of the peripheral wall of the burner main body above the flange.

4. An apparatus as defined in claim 1 wherein the air intakes are formed in the bottom wall and arranged in positions in corresponding relation to the gas-air mixture tubes, the waste gas branch tubes extending upward through the air intakes.

5. An apparatus as defined in claim 1 wherein the combustion furnace main body is supported by a plurality of posts, and the lower portion of the combustion furnace main body including the posts is surrounded at a specified spacing by a soundproof wall.

6. An apparatus as defined in claim 5 wherein the peripheral wall of the combustion furnace main body and the soundproof wall are cylindrical and, when assuming that the inside diameter of the peripheral wall of the furnace is $d$, the inside diameter of the soundproof wall is $D$ is the height of the same is $H$, $D = 1.5d$ to $2.0d$ and $H = 0.5d$ to $1.0d$.

7. An apparatus for incinerating a waste gas comprising a combustion furnace main body having a peripheral wall and a hearth, a plurality of flare burners disposed on the hearth, and a combustion stabilizing tube positioned upright on the hearth at its center and surrounding a required number of the flare burners, each of the flare burners including a burner main body having a peripheral wall and a bottom wall, at least one of the walls of the burner main body being formed with air intakes, an inwardly projecting flange provided on an upper portion of the peripheral wall of the burner main body, gas-air mixture tubes downwardly extending through the flange and arranged at a given spacing, a waste gas main pipe disposed under the burner main body, waste gas branch pipes extending upward from the waste gas main pipe, and gas nozzles mounted on the upper ends of the waste gas branch pipes respectively and positioned at the lower ends of the gas-air mixture tubes, the interior of the stabilizing tube serving as an inner combustion chamber, the space between the stabilizing tube and the peripheral wall of the combustion furnace serving as an outer combustion chamber.

8. An apparatus as defined in claim 7 wherein the combustion stabilizing tube is made of refractory bricks.

9. An apparatus as defined in claim 8 wherein the waste gas main pipes for the inner combustion chamber are connected to a first waste gas duct having a pressure detector, the waste gas main pipes for the outer combustion chamber being connected to a second waste gas duct having a valve and branching off from the first waste gas duct, a main waste gas duct from a waste gas supply being branched into the first waste gas duct and a waste gas duct connected to a gas seal drum, another waste gas duct extending from the gas seal drum and being connected to a flare stack, the pressure detector being operable to emit a signal to open the valve on the second waste gas duct upon detecting that the waste gas has been introduced into the first waste gas duct to specified pressure, the gas seal drum including a water seal which is broken when the waste gas is introduced into the main waste gas duct at a rate in excess of the predetermined capacity of the combustion furnace, permitting the excess of the water gas to flow into the flare stack.

* * * * *